US006457343B1

(12) United States Patent
Shed

(10) Patent No.: US 6,457,343 B1
(45) Date of Patent: Oct. 1, 2002

(54) TUBING SWAGING MACHINE

(76) Inventor: Larry Shed, 424 Jemez St., Hobbs, NM (US) 88240

( * ) Notice: Subject to any disclaimer, the term of this patent is extended or adjusted under 35 U.S.C. 154(b) by 0 days.

(21) Appl. No.: 09/801,460

(22) Filed: Mar. 6, 2001

(51) Int. Cl.[7] ..... B21D 9/05; B21D 9/04

(52) U.S. Cl. ..... 72/401; 72/402; 72/370.01; 72/370.21

(58) Field of Search ..... 72/401, 402, 370.01, 72/370.02, 370.04, 370.1, 370.2, 370.21, 370.26, 370.22

(56) References Cited

U.S. PATENT DOCUMENTS

| | | | | | |
|---|---|---|---|---|---|
| 2,182,663 | A | * | 12/1939 | Eby et al. | 72/402 |
| 3,538,816 | A | * | 11/1970 | Blum | 72/401 |
| 3,759,203 | A | * | 9/1973 | Frankenberg | 72/402 |
| 4,154,082 | A | * | 5/1979 | Beech | 72/370.05 |
| 4,924,586 | A | * | 5/1990 | King et al. | 72/401 |
| 5,160,108 | A | * | 11/1992 | Orain | 72/370.05 |
| 5,634,367 | A | * | 6/1997 | Yamada et al. | 72/370.01 |
| 5,950,482 | A | * | 9/1999 | Nagasawa et al. | 72/370.04 |

FOREIGN PATENT DOCUMENTS

| | | | | |
|---|---|---|---|---|
| DE | 1963 979 | * | 6/1971 | 72/402 |
| JP | 2-127928 | * | 5/1990 | 72/401 |

* cited by examiner

*Primary Examiner*—Daniel C. Crane
(74) *Attorney, Agent, or Firm*—Hurley, Reyes, & Guinn; Aaron R. Clements

(57) ABSTRACT

A tubing swaging machine comprising four coplanar hydraulic cylinders which compress the end of a piece of tubing around a central mandrel. The central mandrel has indentations and is reciprocated by a fifth hydraulic cylinder perpendicular to the plane of the other four cylinders. Each of the four coplanar hydraulic cylinders reciprocate a die which has a surface corresponding to the indentation in the mandrel opposite.

3 Claims, 8 Drawing Sheets

FIG 5
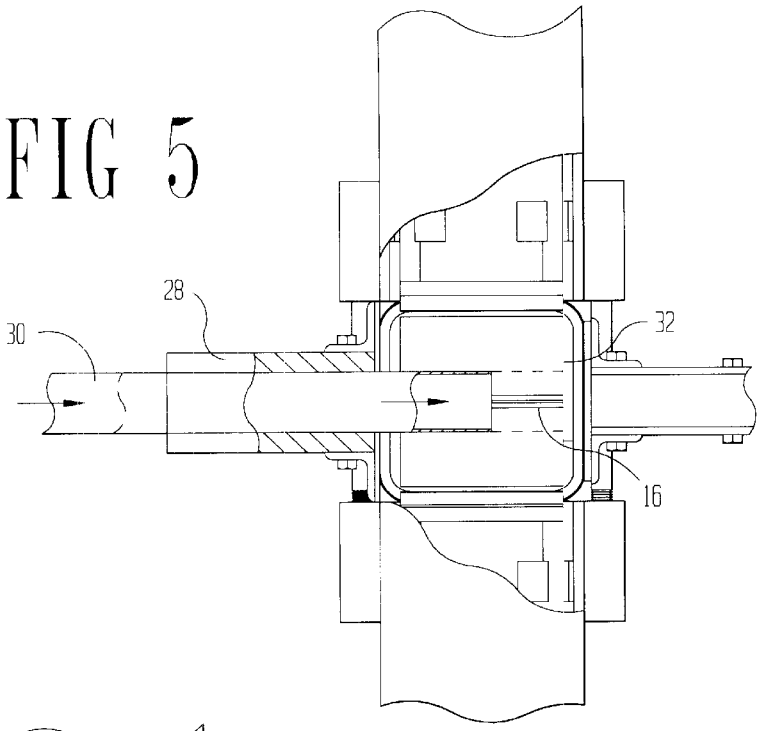
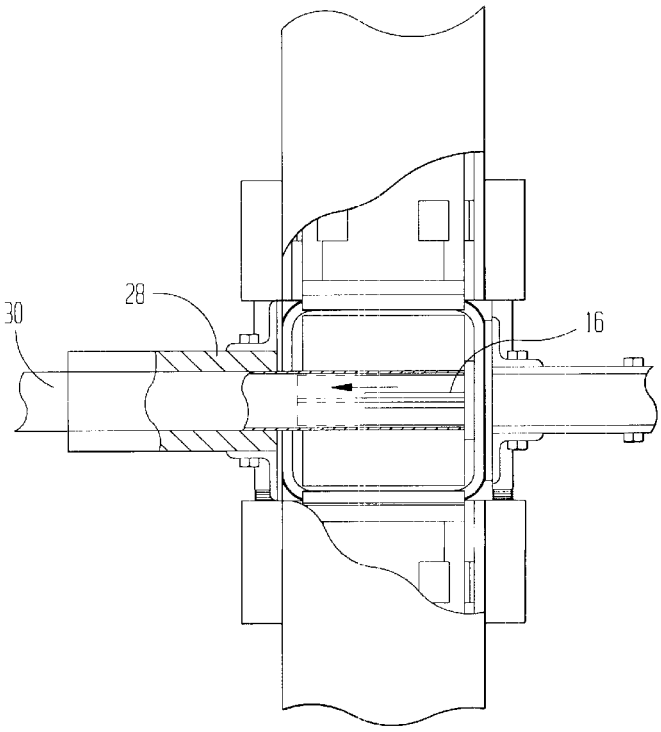
FIG 6

TUBING SWAGING MACHINE

CROSS REFERENCE TO RELATED APPLICATIONS

Not Applicable.

STATEMENT REGARDING FEDERALLY SPONSORED RESEARCH

Not Applicable.

REFERENCE TO "MICROFICHE APPENDIX"

Not Applicable.

BACKGROUND OF THE INVENTION

This Invention relates to a device and method for swaging metal tubing. Swaging is desired in construction, for example, of the framework of buildings to join two pieces of tubing. The desired way is to reduce the outside diameter by swaging the outside diameter of one end so that it is slightly smaller than the inside diameter of the unswaged tubing. This swaging allows the end of one member to be inserted into the unswaged end of another member, wherein the resulting joint can be held in place by a large number of means, including screws, bolts, or welding, if desired.

SUMMARY OF THE INVENTION

The present Invention involves a method and device for swaging tubing through the use of a set of movable dies arranged around a central mandrel. The central mandrel is inserted in the tubing to be swaged and provides a minimum final diameter for the tubing. The mandrel also has indentations which correspond to ridges on the movable dies to assist in reducing the size of the tubing to be swaged. As the dies are compressed against the tubing, the tubing is thereby collapsed around the mandrel and takes on the shape of the mandrel.

DESCRIPTION OF THE DRAWINGS

FIG. 5 is a cutaway view of the machine showing a piece of tubing being inserted through the entry guide.

FIG. 6 is a cutaway view of the machine showing a piece of swaged tubing being removed from the machine.

DETAILED DESCRIPTION OF THE INVENTION

Figure 1:
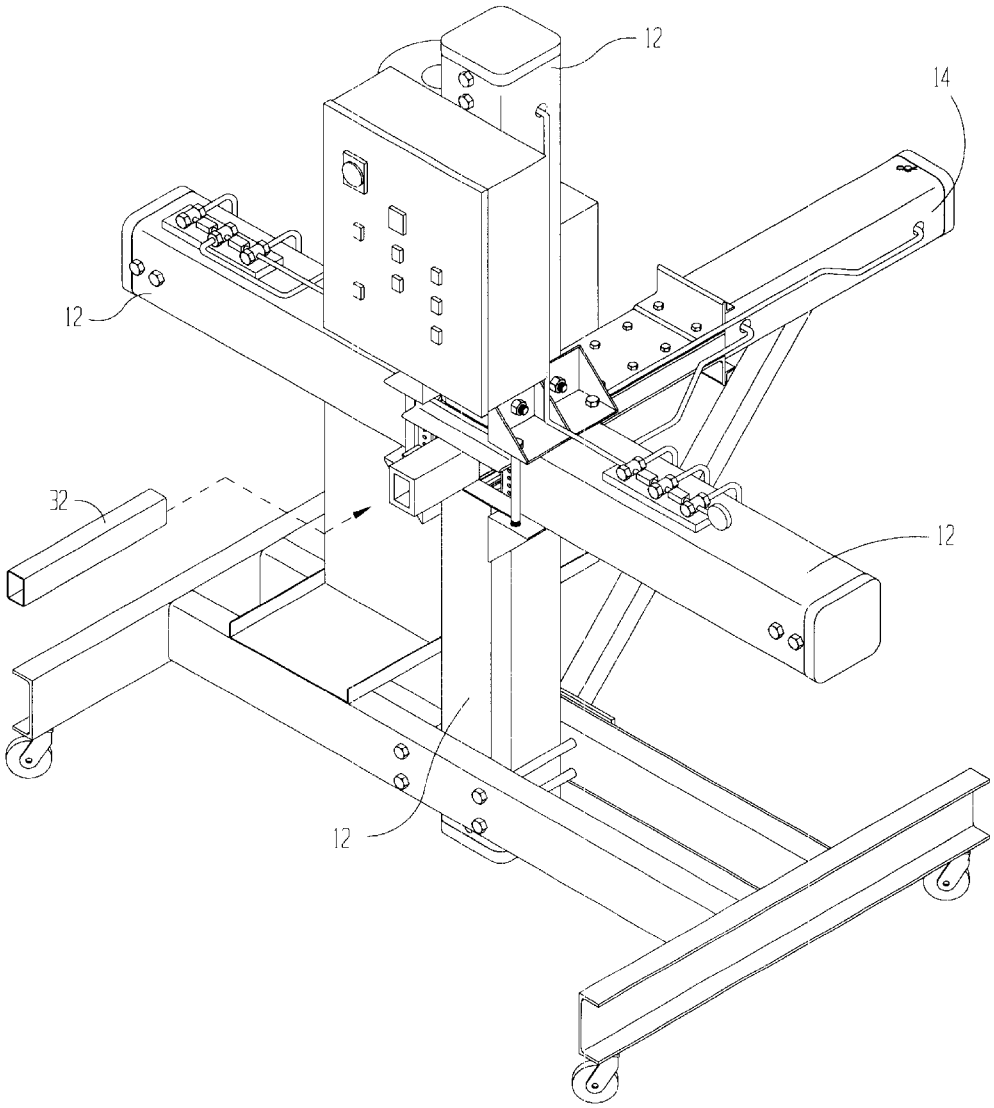
FIG. 1 is an oblique view of the machine in its entirety.
Figure 2:
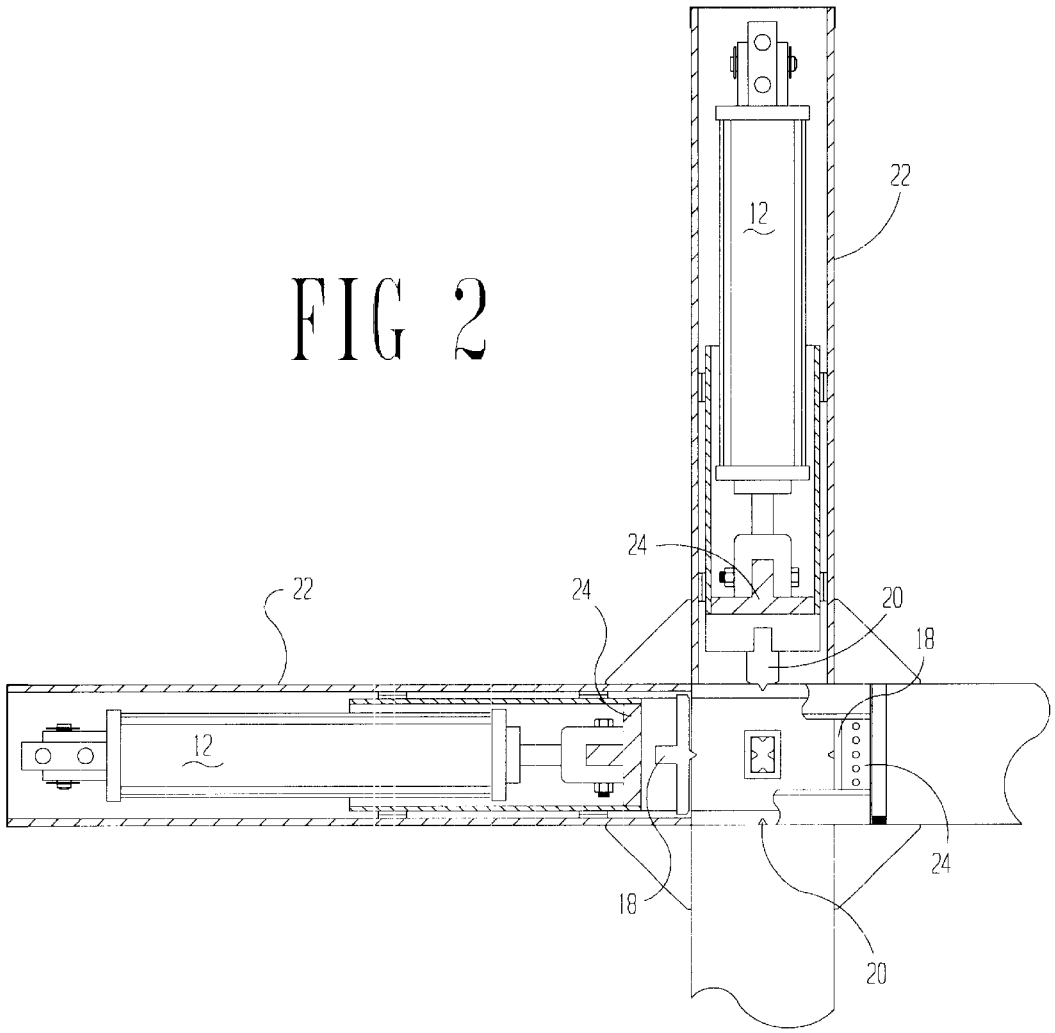
FIG. 2 is a front view of the center of the machine and two of the hydraulic cylinders which reciprocate the dies against the tubing.
Figure 7:
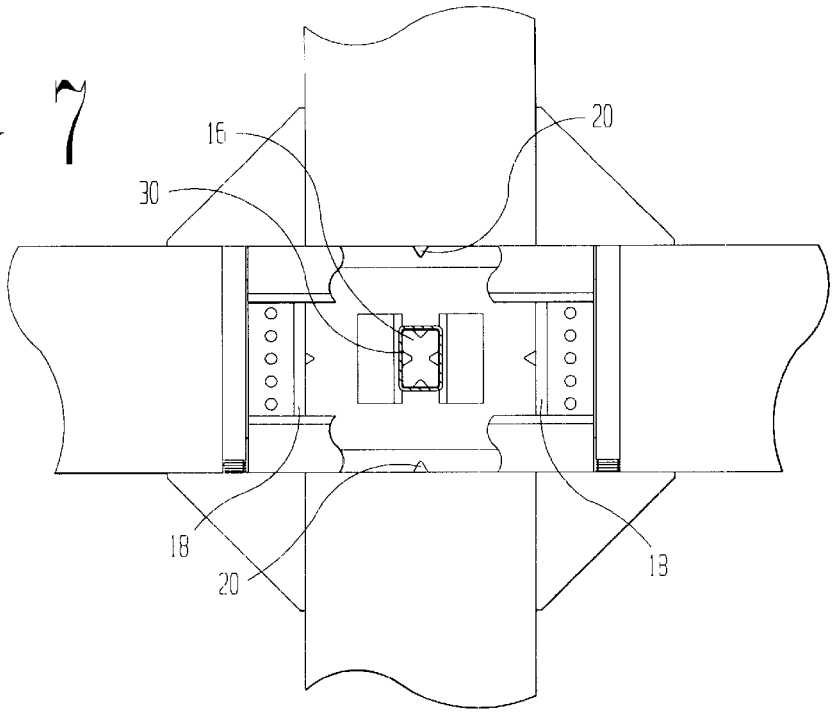
FIG. 7 is a view of the center of the machine prior to compressing the dies against a piece of tubing.

FIG. 1 is an oblique view of the preferred embodiment of the machine comprising the Invention. FIG. 2 is a front view of the central apparatus of the machine, along with two of the hydraulic cylinders 12. One of the main parts of the machine is a mandrel 16. Surrounding the mandrel 16 are two vertical groove making dies 18 and two horizontal groove making dies 20. These also may be seen in FIGS. 7 and 8.

Referring to FIGS. 1 and 2, there are a total of four hydraulic cylinders 12 arranged in a coplanar fashion. There is also a fifth hydraulic cylinder 14 arranged perpendicular to the plane of the four hydraulic cylinders 12. These cylinders are encased in the housings 22. The hydraulic cylinder 14 reciprocates the mandrel 16. As plainly seen in FIG. 2, the hydraulic cylinders 12 reciprocate the vertical dies 18 and horizontal dies 20.

The housings 24 are for the vertical dies 18 and lower dies 20. These parts are also shown on FIGS. 7 and 8.

Figure 3:
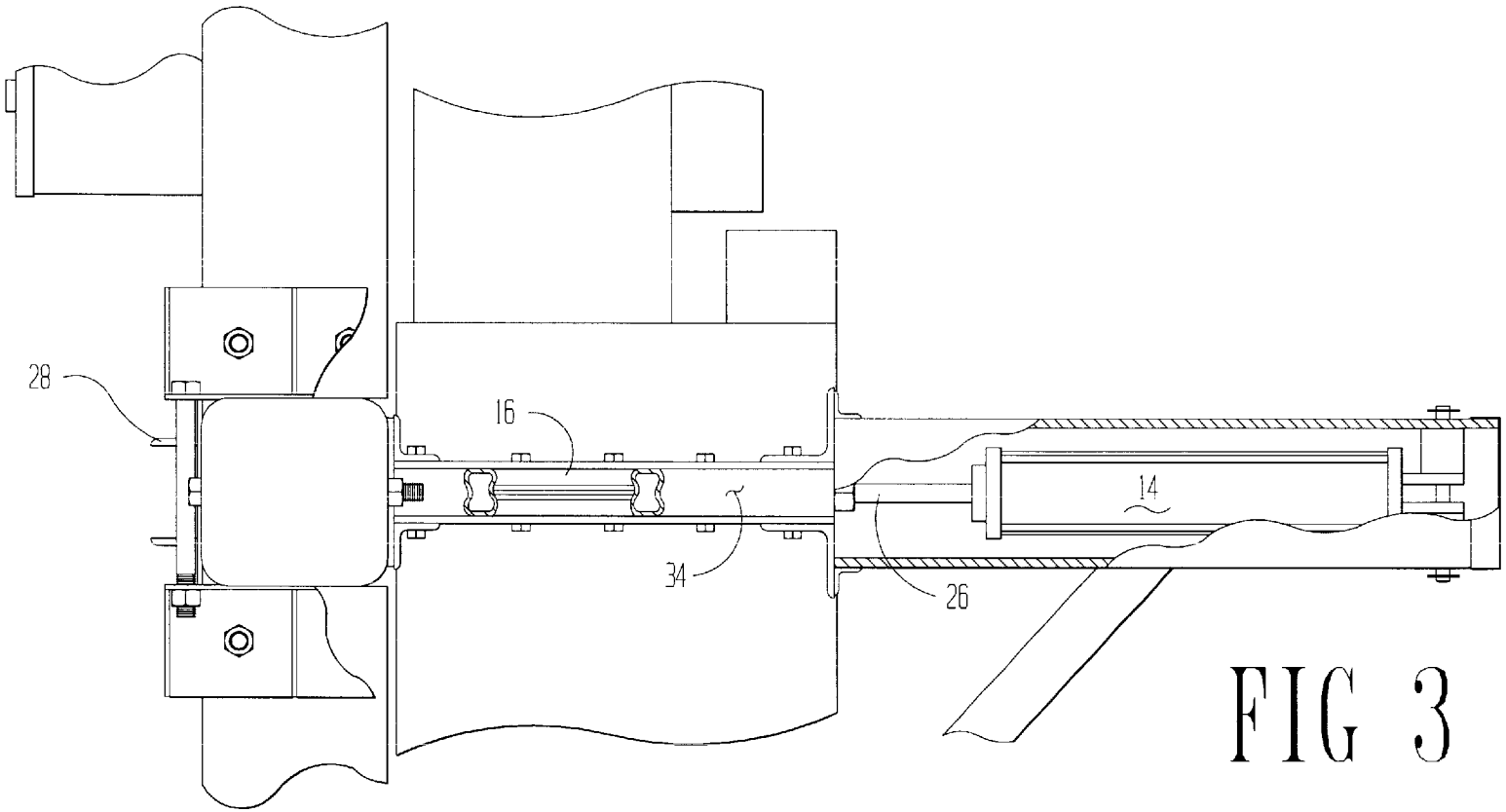
FIG. 3 is a side cutaway view of the machine showing the hydraulic cylinder which reciprocates the mandrel.
Figure 4:
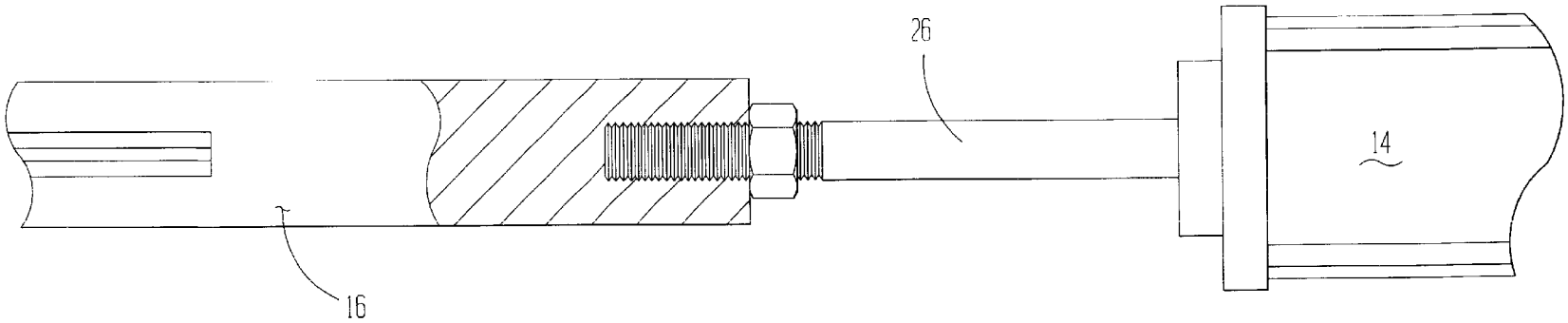
FIG. 4 shows the mandrel attached to a hydraulic cylinder by a threaded end on an extension bar.

Referring particularly to FIGS. 3 and 4 it may be seen that the hydraulic cylinder 14 within the housing 22 is attached to an extension 26 which carries the mandrel 16 on its forward end. FIG. 4 shows the mandrel 16 attached to the extension 26 by means of threads and a nut on the forward end of extension 26.

Referring to FIGS. 1, 5, and 6, it may also be seen that when the rectangular tubing 30 is inserted within the entry guide 28, the inside dimension of the entry guide 28 will be only slightly larger than the outside measurements of the square tubing 30. The drawings show the inside dimension of 28 to be approximately equal to the outside dimension of tubing 30, however, it is understood that the tubing may be placed within entry guide 28.

Figure 8:
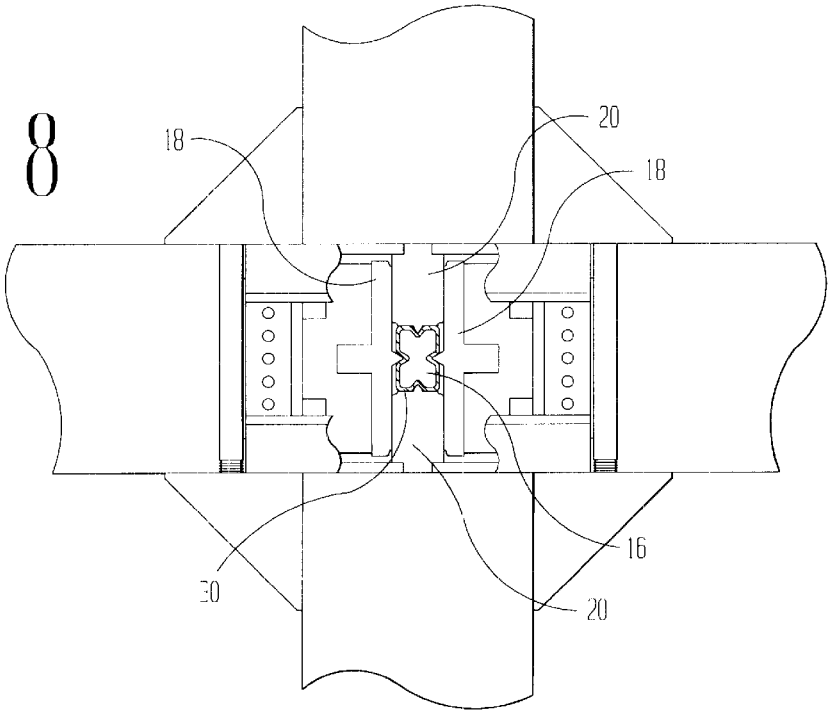
FIG. 8 is a view of the center of the machine after the dies are compressed against a piece of tubing.
Figure 9:
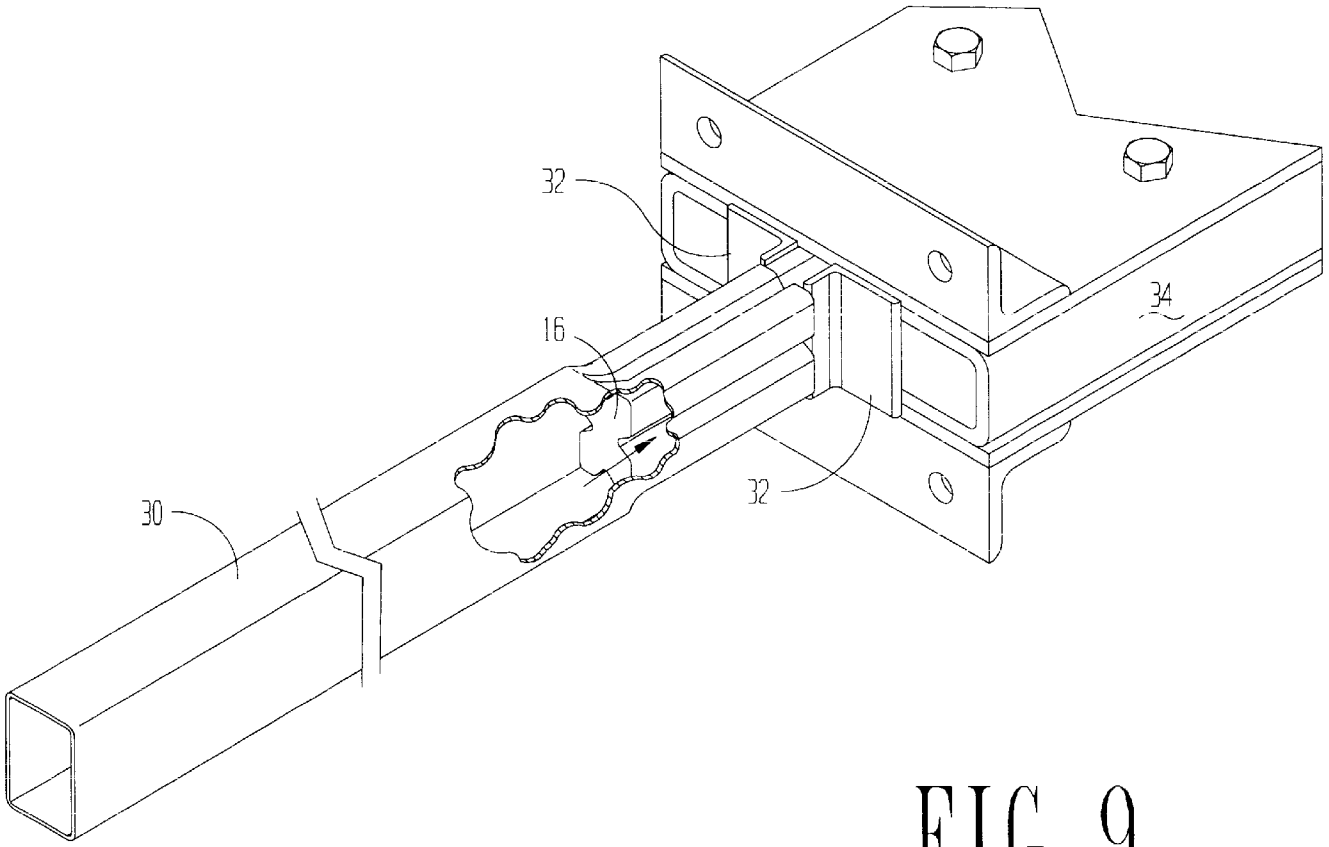
FIG. 9 is a view of the mandrel being retracted from a piece of tubing.
Figure 10:
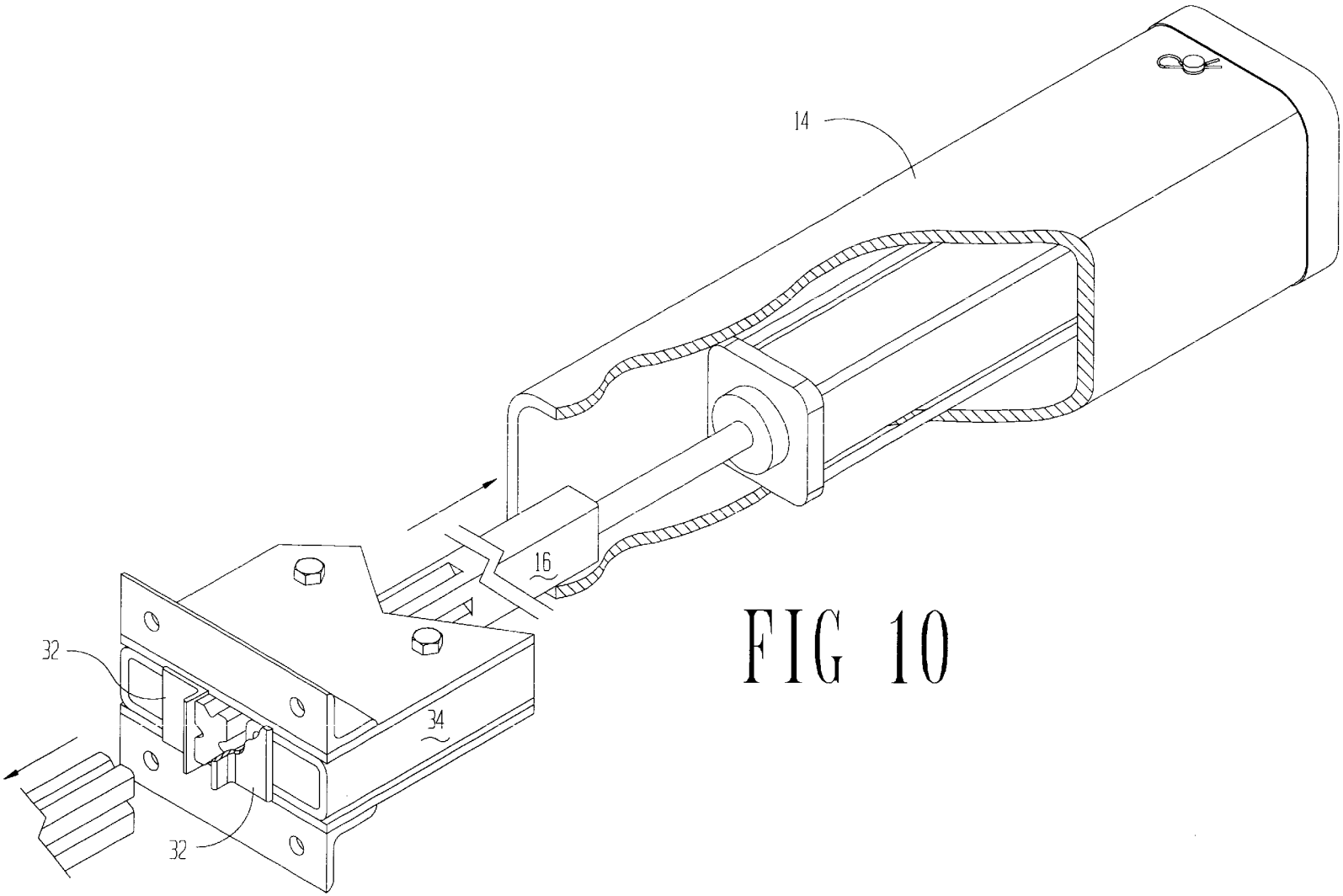
FIG. 10 is a view of the mandrel guide assembly.

The tubing 30 is advanced forward through entry guide 28 until it is stopped by the tube stop 32. At this time, the mandrel 16 is advanced by hydraulic cylinder 14 through the mandrel guide 34 shown in FIG. 10. After the tubing 30 is stopped and the mandrel is advanced, the hydraulic cylinders within the housings 12 are all advanced against the tubing 30, which is telescoped over the mandrel 16. Referring to FIG. 8, when the dies 18 and 20 are compressed against the tubing to form the grooves in the outer surface of the tubing, this will cause the outside dimension to be reduced so that the outside dimension of the swaged portion of the rectangular tubing 30 is slightly smaller than the inside dimensions were before the swaging. After the swaging is completed, the dies 18 and 20 are withdrawn and the mandrel 16 is also retracted. The tubing 30 is retained by the tube stop so that the mandrel 16 may be removed from within the swaged end of the rectangular tubing 30.

Enormous forces are necessary to swage the tubing. Persons with ordinary skill aware of the forces required understand the necessity for powerful hydraulic cylinders as well as sturdy frames and housings. Also, it is understood that the housings of the cylinders support the cylinders. Those with ordinary skill in the art will understand the making of the various parts forming the complete machine.

CATALOGUE OF ELEMENTS

12 Hydraulic Cylinders for Dies
14 Hydraulic Cylinder for Mandrel
16 Mandrel
18 Dies—Vertical groove making dies
20 Dies—horizontal groove making dies
22 Hydraulic cylinder housings
24 Die housings
26 Mandrel extension and mounting bar
28 Entry guide
30 Rectangular tubing

32 Stripper and tubing stop
34 Mandrel guide

The invention claimed is:

1. A swaging machine comprising:

a. a central mandrel having a shape corresponding to the interior of the tubing to be swaged, with said mandrel having four linear depressions down the length of the said mandrel arranged equidistant to each other around the circumference of said mandrel;

b. hydraulic means for reciprocating said mandrel into and out of said tubing;

c. two pairs of dies arranged around and directed towards said mandrel, with each of said dies having a surface shape corresponding to the shape of the surface of said mandrel opposite said die;

d. hydraulic means for compressing said dies against said mandrel and for reciprocating said dies away from said mandrel;

e. an entry guide for aligning said tubing with said mandrel; and f. a stop angle for stopping insertion of said tubing at the appropriate length to be swaged and for holding said tubing stationary while said mandrel is withdrawn from said tubing.

2. The machine of claim 1, wherein said hydraulic means for compressing said dies are coplanar and arranged at right angles to each other, and wherein said hydraulic means for reciprocating said mandrel is arranged perpendicular to the plane of said hydraulic means for compressing said dies.

3. The machine of claim 2, wherein said mandrel has a rectangular shape and wherein said dies have a planar surface and a ridge of a shape corresponding to said depressions in each side of said mandrel.

* * * * *